US007204656B2

(12) United States Patent
Bjuhr

(10) Patent No.: US 7,204,656 B2
(45) Date of Patent: Apr. 17, 2007

(54) ARRANGEMENT PERTAINING TO AN IMPLEMENT ATTACHMENT

(75) Inventor: Niklas Bjuhr, Vindeln (SE)

(73) Assignee: Indexator AB, Vindeln (SE)

( * ) Notice: Subject to any disclaimer, the term of this patent is extended or adjusted under 35 U.S.C. 154(b) by 0 days.

(21) Appl. No.: 10/275,192

(22) PCT Filed: May 4, 2001

(86) PCT No.: PCT/SE01/00978

§ 371 (c)(1),
(2), (4) Date: Oct. 31, 2002

(87) PCT Pub. No.: WO01/83894

PCT Pub. Date: Nov. 8, 2001

(65) Prior Publication Data

US 2003/0103804 A1 Jun. 5, 2003

(30) Foreign Application Priority Data

May 4, 2000 (SE) ..... 0001651

(51) Int. Cl.
*F16B 5/02* (2006.01)
*B66C 23/00* (2006.01)

(52) U.S. Cl. ..... 403/4; 414/723

(58) Field of Classification Search ..... 403/4; 74/571 M, 570; 414/723
See application file for complete search history.

(56) References Cited

U.S. PATENT DOCUMENTS 4,133,121 A * 1/1979 Hemphill
4,207,693 A * 6/1980 Hemphill
4,214,840 A 7/1980 Beales
4,446,753 A * 5/1984 Nagano ..... 403/4 X
4,813,163 A * 3/1989 Livingston et al.
4,890,974 A 1/1990 Kistner
5,927,665 A 7/1999 Grabnic
6,158,917 A 12/2000 Wolin et al.
6,662,681 B2 * 12/2003 Crane et al. ..... 74/571 M

* cited by examiner

*Primary Examiner*—Daniel P. Stodola
*Assistant Examiner*—Victor MacArthur
(74) *Attorney, Agent, or Firm*—Rolf Fasth; Fasth Law Offices

(57) ABSTRACT

The arrangement is for coupling an implement attachment to a working arm of a working machine. The arm is connected to the implement attachment through the medium of fastener sleeves and fastener pins. The attachment includes two side-plates which each carry two bushings that include holes for accommodating the fastener pins. The bushings have a circular guide portion which fits into a circular hole in respective side-plates. The bushings include a respective flange that is connected to the side-plates by a fastener element. The hole, that receives respective fastener pins, is positioned eccentrically in relation to the guide portion in respect of at least two of the bushings.

7 Claims, 2 Drawing Sheets

ARRANGEMENT PERTAINING TO AN IMPLEMENT ATTACHMENT

PRIOR APPLICATIONS

This application is a U.S. national phase application based on International Application No. PCT/SE01/00978, filed 4 May 2001; which claims priority from Swedish Application No. 0001651-9, filed 4 May 2000.

FIELD OF INVENTION

The present invention relates to an arrangement and method pertaining to an implement.

BACKGROUND AND SUMMARY OF INVENTION

Various types of machine tools, such as excavators, for example, include an arm to which different implements/tools can be connected. The arm thus includes means for connection with the implement attachment. A typical fastener system used in respect of the working arm/shaft/dipper stick of an excavator, digger or corresponding machine resides in the provision of two mutually parallel fastener pins at the tip of said arm, these pins engaging the implement attachment. However, different makes of such machines have different measurements and distances with respect to said fastener pins, therewith requiring the implement attachment to be especially designed for different machine sizes and machine makes. Among other things, this presents a problem with respect to the stocking aid the delivery of both the implement attachments and the implements, tools, or mounting systems carried thereby.

The above-mentioned problems are described in U.S. Pat. No. 5,927,665. This US patent specification proposes the use of adapter plugs or bushes of relatively complicated outer contours, said bushes being held in place by means of screws that pass transversely through the bushes and fastener pins. The fastener pins must therefore be designed especially. The adapter plugs are expensive to produce because of a complex construction, and the side-plate cut-outs or recesses required for the adapter plugs are also complicated and expensive. It is also difficult to achieve a close fit.

An object of the present invention is to provide an extremely simple and attractive arrangement with which the aforesaid problems can be solved. This object is achieved with an inventive arrangement and inventive method having the characteristic features set forth in the accompanying Claims.

Of the many advantages afforded by the present invention it can be mentioned that the design of the bushes is highly beneficial from a total working aspect. Prevention of rotation of the bushes and fixation of said bushes relative to the side plates is achieved with simple means. Another advantage afforded by the inventive arrangement is that the fastener pins provided by the machine manufacturers can usually be used without requiring modification. The invention also affords both technical and economical advantages.

BRIEF DESCRIPTION OF DRAWINGS

The invention will now be described by way of example and also with reference to the accompanying drawings, in which.

DETAILED DESCRIPTION

Figure 1:
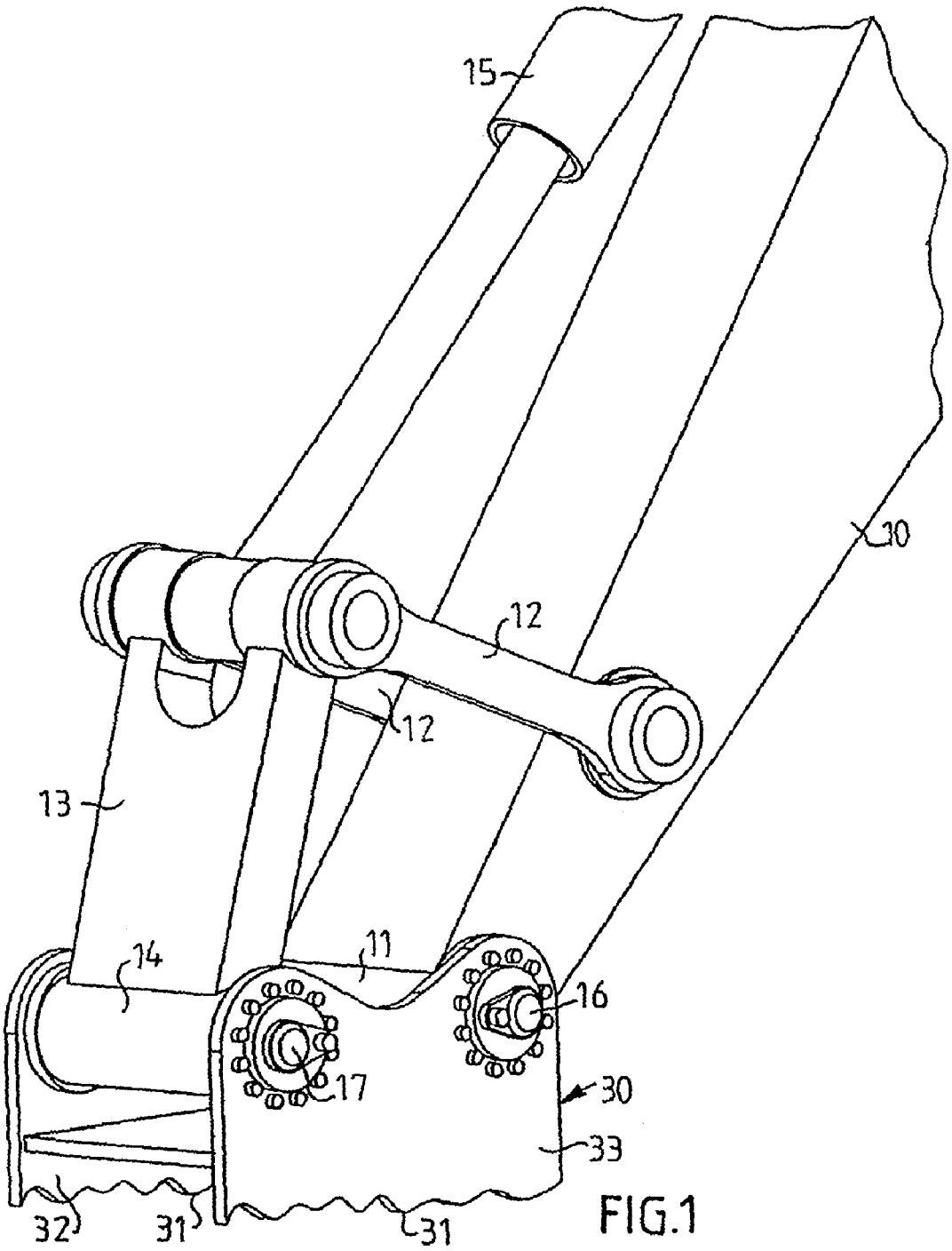
FIG. 1 is a perspective illustration of a working arm in the form of a digger shaft that carries an inventive implement/tool attachment.

FIG. 1 illustrates a typical working arm 10 of an excavator, digger or corresponding machine. The arm 10, which is also known as the machine shaft or dipper stick, carries an inventive implement attachment 30. The arm 10 is shown to carry a fastener sleeve 11 at its lower end. The arm 10 carries a pair of linkage arms 12 which, in turn, carry a lower linkage arm 13. A fastener sleeve 14 is carried at the free end of the linkage arm 13. The working movement of the linkage arms 12 and 13 is effected by a manoeuvering device in the form of an hydraulic cylinder 15. The implement attachment 30 is coupled to the arm 10 by means of two fastener pins 16,17 that extend through the sleeves 11 and 14. Different makes of machine have different positioning of the fastener sleeves 11,14 and their associated fastener pins 16,17, and also vary with respect to sleeve and pin measurements.

The inventive implement attachment 30 is designed so that it can be readily adapted td the measurements and geometric variations of the sleeves 11,14 and the pins 16,17.

The implement attachment 30 can, of course, carry all conceivable types of implement/tools, such as rotators, buckets, shovels, hydraulic hammers, gripping claws, etc. The implement attachment 30 may also carry a quick-fastener or some similar mounting system designed for the implement concerned. Although no implement is shown in the figures, it will be understood that the bottom part 31 of the attachment 30 can be adapted to the implement in question.

The attachment 30 includes two side-plates 32,33 which support an implement/tool (not shown), either directly or indirectly. The side-plate 32 includes two circular holes 34,35, and the side-plate 33 includes two circular holes 36,37. The diameters of the holes 34–37 are much larger than the diameters of respective pins 16,17, so as to enable inventive bushes 44–47 to be mounted in said holes.

Figure 2:
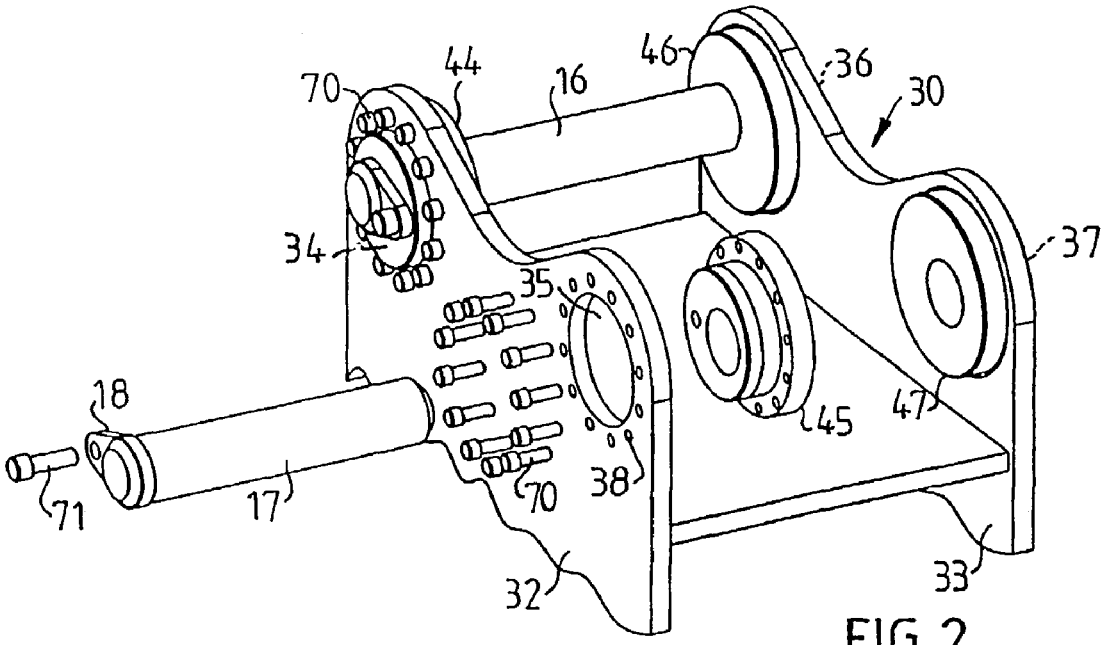
FIG. 2 is a partially exploded perspective view, showing the implement attachment loosened from the shaft.
Figure 3:
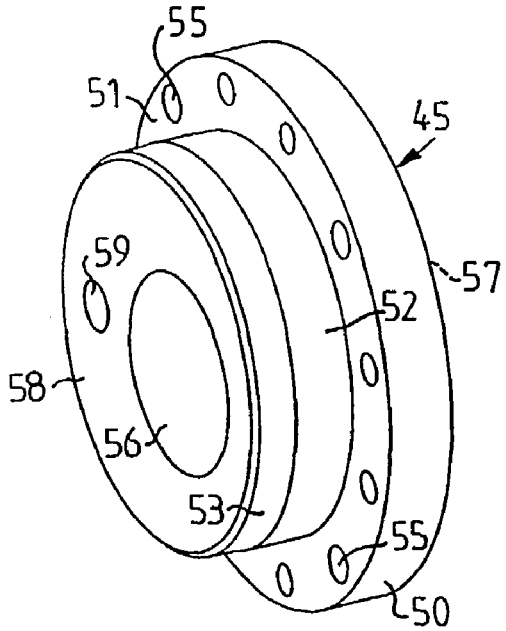
FIG. 3 is an enlarged perspective view of a bushing.

The bushes 44–47 include a circular flange 50 that has an inner surface 51 which lies against the inside of the side-plates 32,33, and a circular guide portion 52 which fits snugly in the circular holes 34–37, i.e., in the absence of play. In order to facilitate fitting of the bushes 44–47 in respective holes 34–37, the circular guide portion 52 is provided with an entry portion 53 of slightly smaller diameter than its remaining part. The flanges 50 include a plurality of screw-threaded blind holes 55, and the side-plates 32,33 include-corresponding holes 38, so as to enable the bushes 44–47 to be anchored to the side-plates 32,33 by means of screws 70, as shown in FIGS. 1 and 2. It is possible to substitute one or more of the screws 70 for guide pins, provided that the holes in the side-plates 32,33 and in the flanges 50 are adapted to this end.

In accordance with the invention, the bushes 44–47 are adapted to the fastener sleeves 11,14 and the fastener pins 16,17 concerned, by providing holes 56 for the fastener pins 16,17 through the bushes, these holes most often being positioned eccentrically in relation to the center line of the circular guide portion 52. The circular guide portion 52 has been given a diameter which can accommodate variations in the fastener-pin hole patterns from the machine manufacturers to be covered. The thickness of the flanges of respective bushes 44–47 is adapted to the lengths of respective fastener sleeves concerned, so that the clearances between the fastener sleeves 11,14 and the outer end plane 57 of respective flanges 50 will be a minimum.

One end of the illustrated fastener pins 16,17 carries a perforated shoulder 18, wherewith the pins can be secured in their position of use by screwing said pins into the outer end surface 58 of the bush in questions said end surface including a screw-threaded hole 59 for receiving a screw fastener 71. It will be readily seen that the bushes 44–47 can be easily adapted to enable the use of other commercially-available fastener pins, without needing to modify said pins.

Thus, the inventive implement attachment enables a common attachment including relevant implement and/or accessory, to be finally adapted to comply with customer requirements in conjunction with delivery, by screwing the bushes concerned firmly to the implement attachment. This provides significant advantages with respect to stock holding and delivery times. It is also possible to subsequently change the implement attachment by simply exchanging the bushes, therewith enabling the attachment to be fitted to excavating machines, digging machines, etc., of other manufactures. The invention thus provides a highly rewarding flexibility.

It will also be noted that the outer cylindrical shape of the guide portion of the respective bushes enables play-free connection with corresponding holes in the side-plates, this facility being highly significant from the life expectancy of the bush. However, the outer contour of the flange may deviate from the illustrate cylindrical contour if so desired, for instance when necessary because of space problems.

It will be understood that the detail design of the side-plates may be varied within the scope of the invention, and also their connection to relevant implements or mounting systems.

While the present invention has been described in accordance with preferred compositions and embodiments, it is to be understood that certain substitutions and alternations may be made thereto without departing from the spirit and scope of the following claims.

The invention claimed is:

1. An arrangement for coupling an implement attachment to a working arm of a working machine, comprising:

an implement attachment having two side-plates which each carry two bushings having openings defined therein for receiving fastener pins;

the side-plates have a circular hole defined therein, the bushings being adapted to fit in the circular hole;

the bushings being secured to the side-plates by a fastener element;

each bushing having a round guide portion, each round guide portion being rotatable within one of the circular holes of the side-plates, each guide portion having an opening defined therein for receiving one of the fastener pins; and the openings being eccentrically positioned in at least one of the bushings for each side-plate so that a rotational positioning of the bushings is selectable to align the eccentric openings of the bushings with a position of the fastener pins prior to securing the bushings with the fastener element wherein each fastener pin is locked to the round guide portion by a second fastener element that is screwed into a screw-threaded hole in the round guide portion.

2. An arrangement according to claim 1, characterized in that the fastener element extends through respective side-plates and is anchored to a flange of each respective bushing.

3. An arrangement according to claim 1, characterized in that the thickness of a flange is adapted so that the flange fills-out a distance between the side-plates and end parts of fastener sleeves.

4. An arrangement according to claim 1, characterized in that the side-plates are connected to an implement, tool, or mounting system.

5. A method of coupling an implement attachment to a working arm of a working machine, comprising:

connecting the arm to the implement attachment via fastener sleeves and first and second fastener pins, providing the implement attachment with two side-plates which each carry two bushings that have openings defined therein for receiving said fastener pins where at least one bushing carried by each side-plate has an eccentrically positioned opening defined therein;

providing at least one bushing having a round guide portion which rotatably fits into a circular hole defined in the side-plates;

selecting a rotational position of the eccentric opening of one of the round guide portions to set a desired distance between the first and the second fastener pin;

locking the bushings in the selected rotational position by activating a fastening element to prevent rotational movement of the bushing; and locking the first fastener pin to the round guide portion by anchoring a fastener to the round guide portion.

6. A method according to claim 5, wherein the method further comprises screwing the fastener into a screw-threaded hole in the round guide portion and adapting the attachment to varying length measurements of the fastener sleeves, by varying a thickness of a flange provided on each respective bushing.

7. An arrangement for coupling an implement attachment to a working arm of a working machine, comprising:

an implement attachment having two side-plates which each carry two bushings having openings defined therein for receiving fastener pins;

the side-plates have a circular hole defined therein, the bushings being adapted to fit in the circular hole;

the bushings being secured to the side-plates by a fastener element;

each bushing having a round guide portion, each round guide portion being rotatable within one of the circular holes of the side-plates, each guide portion having an opening defined therein for receiving one of the fastener pins; and the openings being eccentrically positioned in at least one of the bushings for each side-plate so that a rotational positioning of the bushings is selectable to align the eccentric openings of the bushings with a position of the fastener pins prior to securing the bushings with the fastener element wherein each fastener pin is locked to the round guide portion by a second fastener element that is anchored within the round guide portion.

* * * * *